US009358694B1

(12) United States Patent
Heumann et al.

(10) Patent No.: US 9,358,694 B1
(45) Date of Patent: Jun. 7, 2016

(54) HAND GUARD

(71) Applicants: Sean Heumann, Louisville, KY (US); William L Heumann, Prospect, KY (US)

(72) Inventors: Sean Heumann, Louisville, KY (US); William L Heumann, Prospect, KY (US)

( * ) Notice: Subject to any disclaimer, the term of this patent is extended or adjusted under 35 U.S.C. 154(b) by 123 days.

(21) Appl. No.: 14/294,456

(22) Filed: Jun. 3, 2014

(51) Int. Cl.
*B26B 29/02* (2006.01)

(52) U.S. Cl.
CPC ..... *B26B 29/02* (2013.01)

(58) Field of Classification Search
CPC ..... B26B 29/00; B26B 29/02; B26B 29/025
USPC ..... 403/381
See application file for complete search history.

(56) References Cited

U.S. PATENT DOCUMENTS 542,568 A 7/1895 Miller
1,586,412 A * 5/1926 Curtis ..... F41B 15/02 16/110.1
1,784,334 A * 12/1930 Callum ..... B26B 29/02 30/295
2,184,902 A * 12/1939 Henry ..... B26B 3/00 30/295
2,650,424 A * 9/1953 Kalmon ..... A22B 5/168 30/286
2,901,824 A 9/1959 Zullo
3,538,605 A * 11/1970 Smith ..... B26B 29/02 30/295
4,034,982 A * 7/1977 Rupprecht ..... F41B 15/08 463/47.2
4,211,381 A * 7/1980 Heard ..... G09F 7/18 248/225.11
4,987,682 A 1/1991 Minnick
5,127,871 A 7/1992 Miller
5,188,362 A * 2/1993 Ashihara ..... F41B 15/025 463/47.6
5,575,070 A * 11/1996 Anderson ..... B26B 29/02 30/283
6,061,862 A 5/2000 Whitaker
6,131,354 A * 10/2000 Thompson ..... E05C 19/006 248/208
D610,399 S 2/2010 Hamlin
7,658,664 B2 * 2/2010 Tong ..... A63H 33/009 273/403
8,328,253 B2 * 12/2012 Wales ..... A47J 37/1271 294/131
2013/0192069 A1 8/2013 Reibold

FOREIGN PATENT DOCUMENTS

GB 2392111 2/2004

* cited by examiner

*Primary Examiner* — Sean Michalski
*Assistant Examiner* — Jonathan Riley
(74) *Attorney, Agent, or Firm* — Theresa Camoriano; Guillermo Camoriano; Duncan Galloway Egan Greenwald

(57) ABSTRACT

A hand guard strap which mounts to and is held onto the handle of a tool, such as a knife, by sliding onto the handle at distal and proximal ends, the hand guard being held in a secured position by means of spring tension in the strap.

9 Claims, 7 Drawing Sheets

HAND GUARD

BACKGROUND

The present invention relates to a removable hand guard which may be used on the handle of a tool, such as a knife.

Most of the hand guards that have been used in the past are permanently affixed to the tool or are attached via screws, rivets, straps, clamps, cotter pins, or other fastening mechanisms.

SUMMARY

An embodiment of the present invention provides a hand guard which may be readily installed directly onto a tool handle without requiring any tools and without requiring a fastener.

DESCRIPTION

Figure 1:
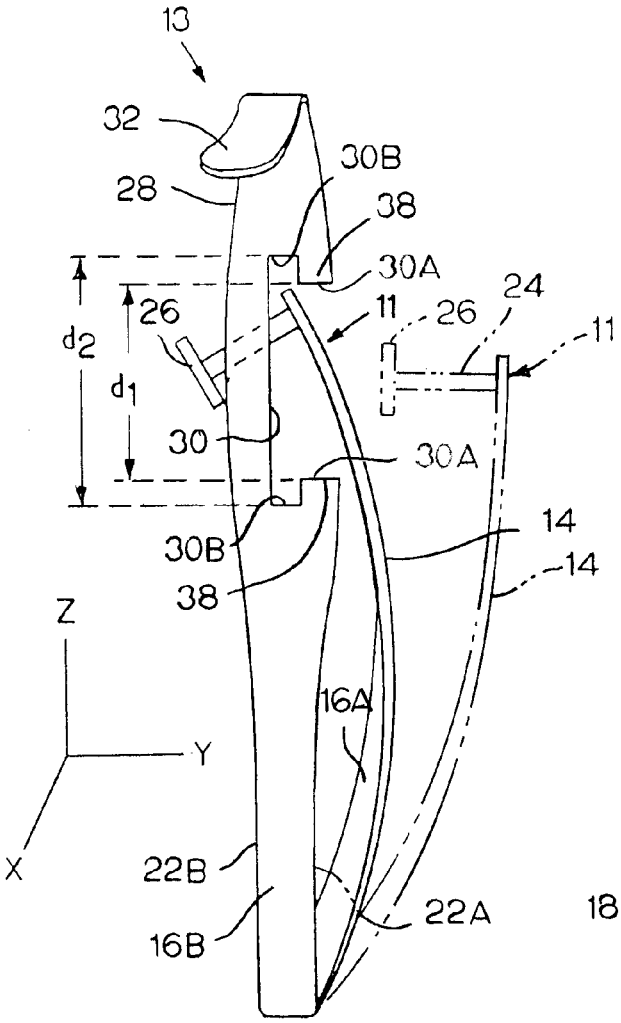
FIG. 1 is a front perspective view of a hand guard, with part of the guard shown in phantom in a first position and in solid in a second position.

FIGS. 1-5 show a hand guard 10. The hand guard 10 is designed to be mounted on the handle 18 of a hand tool 12, such as a knife, without requiring fasteners such as screws, rivets, straps, clamps, or cotter pins. In this particular embodiment, the hand tool 12 is a knife, but it could be a saw, a hammer, or any of a number of known hand tools. As explained in more detail below, the hand guard 10 is mounted on the handle 18 in a manner that creates a spring tension in the hand guard in two substantially perpendicular directions, which urges the hand guard in directions that keep the hand guard retained on the tool handle.

The hand guard 10 is a generally "U"-shaped strap 14 having a proximal end 11 and a distal end 13.

This hand guard 10 preferably is manufactured from a strong, resilient material, such as from hi-tensile steel, which can be deformed for installation but which tends to snap back to its at-rest configuration when the deforming force is removed. The strap 14 of the hand guard 10 has flat, wide, inner and outer faces 16A, 16B, respectively, and first and second edges 22A, 22B, and the strap 14 is twisted when the hand guard 10 is mounted on the handle 18, so that the flat outer face 16B faces in the X direction (forward) (See FIG. 1) at the distal end 13, and in the Y direction (to the right) at the proximal end 11, as seen best in FIG. 1. The first edge 22A faces in the Y direction (to the right) at the distal end 13 and in the X direction (forward) at the proximal end 11.

FIG. 1 is a perspective view taken from the front of the hand guard 10. Three perpendicular axes X, Y, and Z are shown for reference, with the X axis being directed in the forward direction, the Y axis projecting to the right, and the Z axis projecting upwardly. As better appreciated in combination with FIGS. 3 and 4, the X-axis corresponds to the longitudinal direction of the tool 12, which in this case is a knife, having a blade 20, and the longitudinal direction is a direction extending from the handle 18 to the tip of the knife 12.

Referring back to FIG. 1, the proximal end 11 of the hand guard 10 includes a pin 24 projecting from the inner flat face 16A of the strap 14 and extending substantially in the negative Y direction (to the left), with a larger diameter head 26 at the free end of the pin 24.

At the distal end 13 of the strap 14, is a "T"-shaped slotted opening 30 for receiving the blade 20, as explained in more detail later. The T-shaped slotted opening 30 has a base 30A, which is located between two tabs 38, and it has two arms 30B, located inwardly, away from the first edge 22A. The base 30A of the T forms the open side of the T-shaped slotted opening, and the arms 30B form the closed side. The open base 30A of the T forms a short inlet along the edge 22A, having a longitudinal distance $d_1$ between the two opposed tabs 38. The arms 30B of the T-shaped slotted opening 30 extend for a longitudinal distance $d_2$ along the strap 14.

Figure 2:
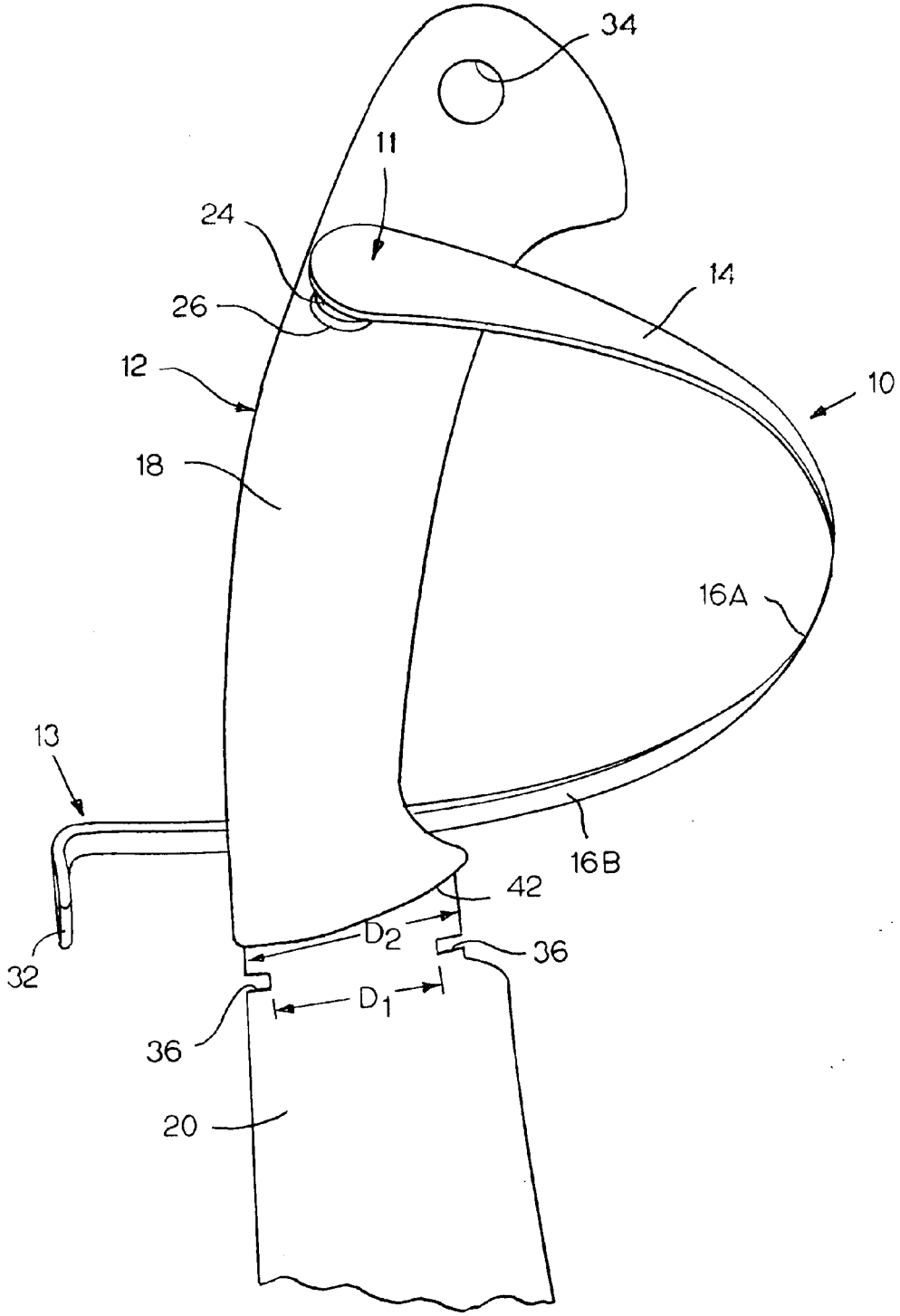
FIG. 2 is a perspective view of the guard of FIG. 1 as it is being installed onto the handle of a tool.
Figure 3:
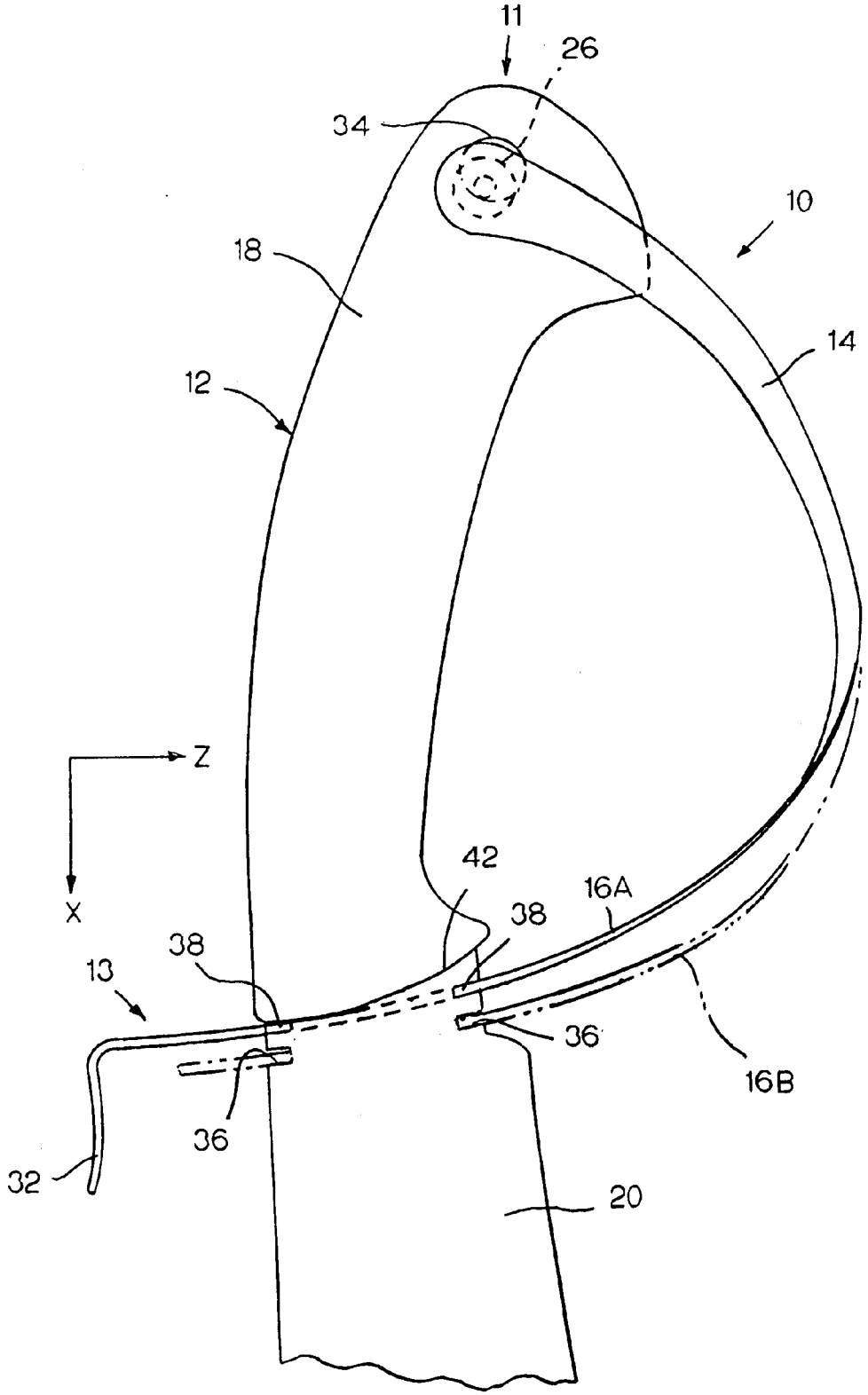
FIG. 3 is a perspective, partially broken-away view of the right side of the tool (with the left and right sides being defined from the point of view of a person looking from the tip of the tool toward the handle) with the hand guard installed, and with the distal end of the guard shown broken away in phantom in a first position and in solid in the final, installed position.

When the hand guard 10 is installed on the handle 18, with the strap 14 being twisted, as shown in FIGS. 1, 2 and 3, the base 30A of the "T"-shaped slotted opening 30 opens in the positive Y direction (to the right), substantially opposite to the direction in which the pin 24 projects from the strap 14. The tip of the distal end 13 of the strap 14 is bent at a right angle to define a forward projection or forward tab 32 extending in the X direction to aid the user in pulling on the distal end of the hand guard 10 during installation of the hand guard 10 onto the tool 12.

The distal tip of the strap 14 is bent outwardly to form the forward tab 32, which is located distally from the T-shaped opening 30.

Figure 4:
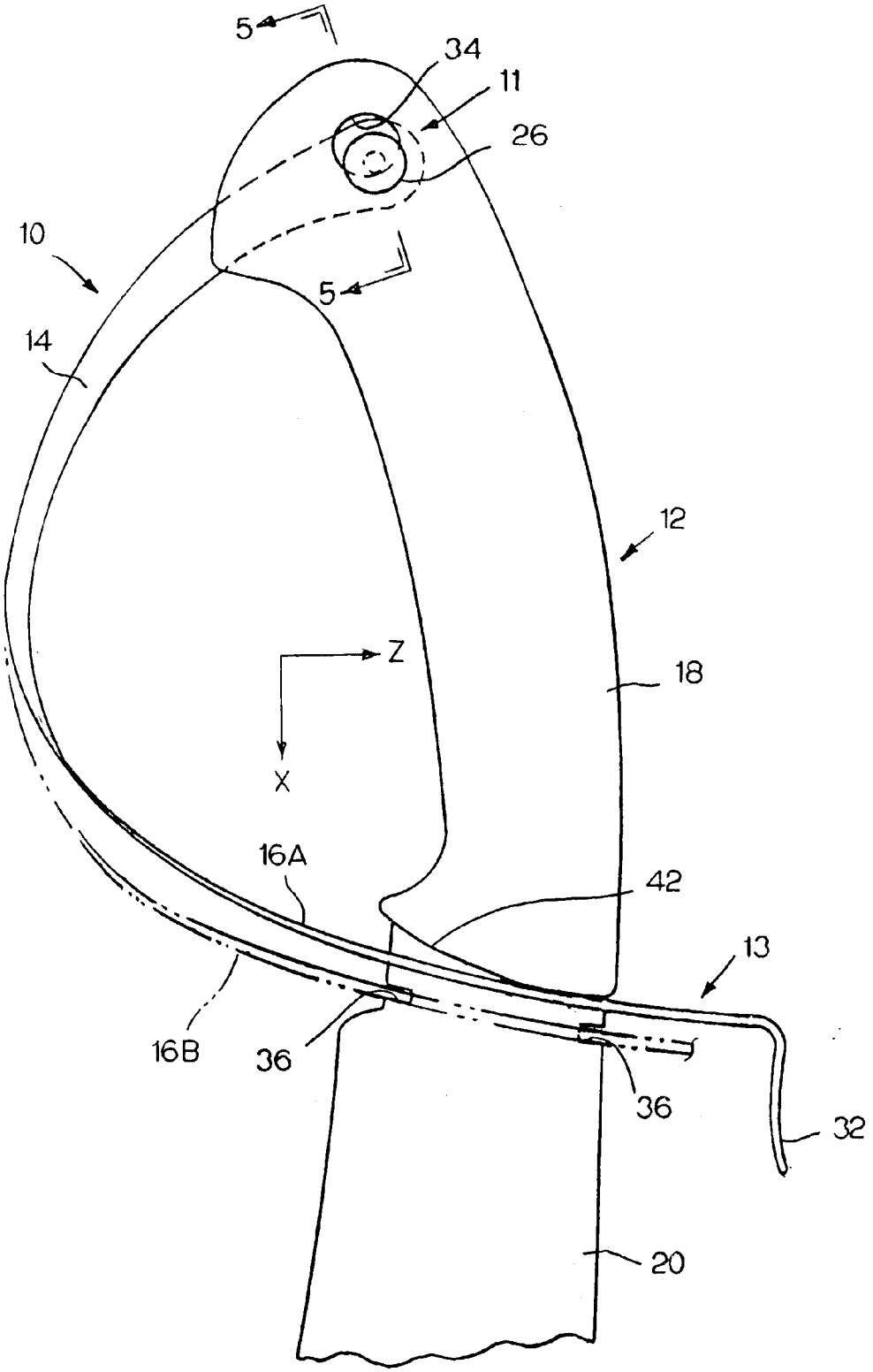
FIG. 4 is a perspective, partially broken-away view of the left side of the tool with the hand guard installed, and with the distal end of the guard shown in phantom in a first position and in solid in the final, installed position.
Figure 6:
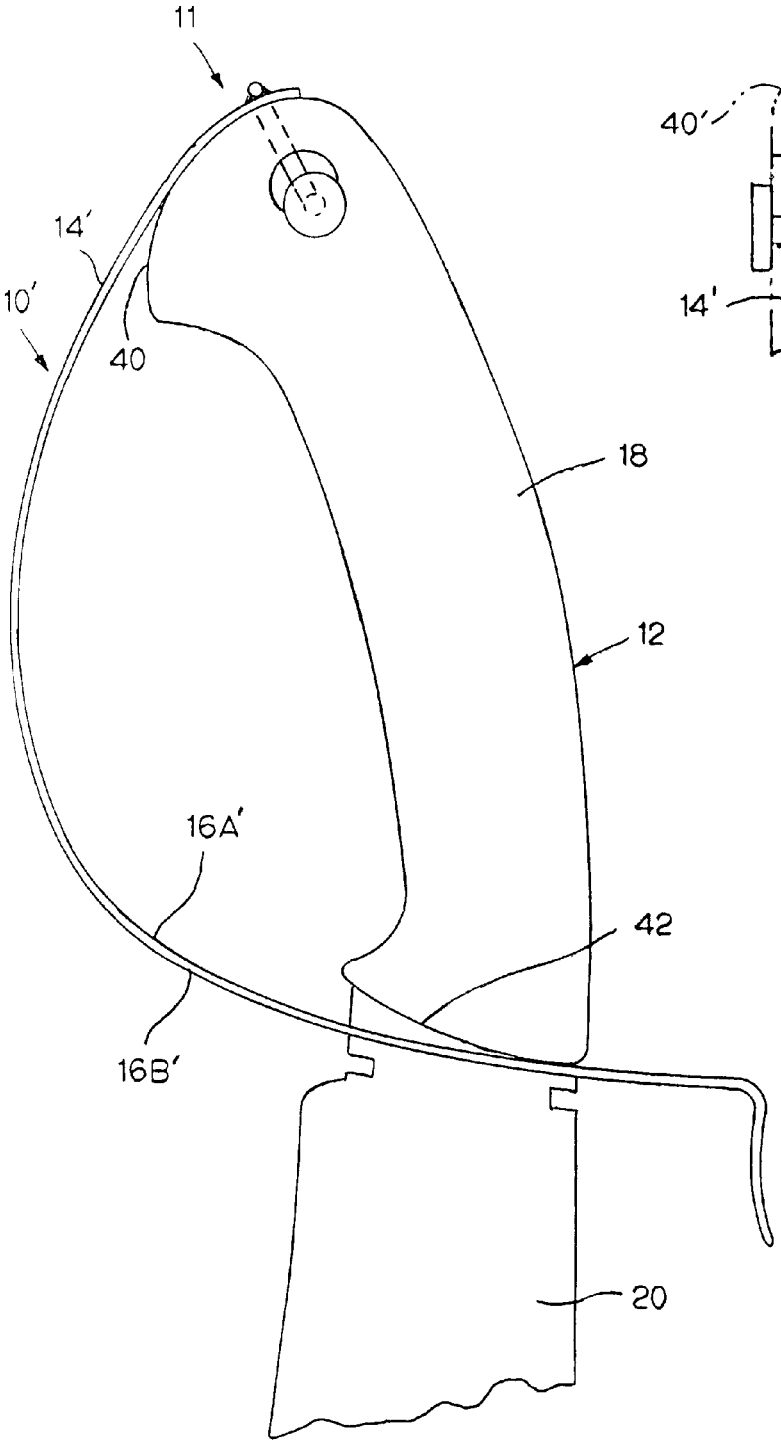
FIG. 6 is a partially broken-away view of the left side of the tool with a second embodiment of a hand guard installed.
Figure 7:
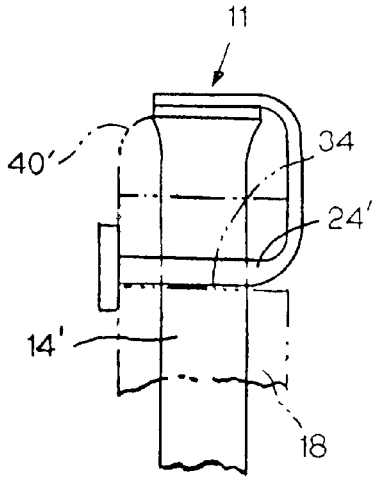
FIG. 7 is a broken-away bottom view of the end of the guard of FIG. 6, with the tool handle shown in phantom.

Referring now to FIG. 2-4, the tool 12 has a handle 18 with a small through hole 34 at its proximal end, and a knife blade 20 projecting in the forward direction from the handle 18 (along the X axis). The blade 20 is broken away, but it is understood that the blade 20 extends a substantial distance in the distal direction. Most tool handles 18 already have an opening 34 which may be used to secure a lanyard to the handle 18 or to provide a means for hanging the tool 12 on a peg on a wall. If this opening 34 is absent, the user would drill such an opening in order to install the hand guard 10.

The blade 20 defines two small notches 36, directly opposed to each other, in the upper and lower edges of the blade 20 adjacent to the handle 18. As shown by looking at both FIGS. 1 and 2, the distance "$D_1$" (See FIG. 2) between the innermost points of the two notches 36 on the blade 20 is slightly less than the distance "$d_1$" (See FIG. 1) between the narrow inlet points of the "T"-shaped slot 30 of the hand guard 10. If the tool 12 as sold off-the-shelf does not have these notches 36, a user may grind or cut these notches 36 in order to install the hand guard 10. While the notches 36 are shown here as being in the blade 20 adjacent to the handle 18, they could instead be in the handle 18 itself, with a shoulder formed proximal of the notches.

It should be noted that the notches 36 also may be referred to herein as slots or recesses.

The distance "$D_2$" is the width of the blade 20 directly to the rear of the notches 36, and it is slightly less than the distance "$d_2$" (See FIG. 1) between the arms 30B of the "T"-shaped slotted opening 30 of the hand guard 10. The distal end of the handle 18 is larger than the blade 20 where the blade 20 projects distally from the handle 18, thereby forming a distal shoulder 42 proximal to the notches 36.

To install the hand guard 10 on the knife 12, the hand guard 10 is placed adjacent to the handle 18 with the proximal end 11 on the right side of the handle 18 near the hole 34 and the distal end 13 on the left side of the handle 18 near the notches 36, and with the remainder of the hand guard 10 passing underneath the handle 18 and crossing over from the right side to the left side, as shown in FIG. 2.

Figure 5:
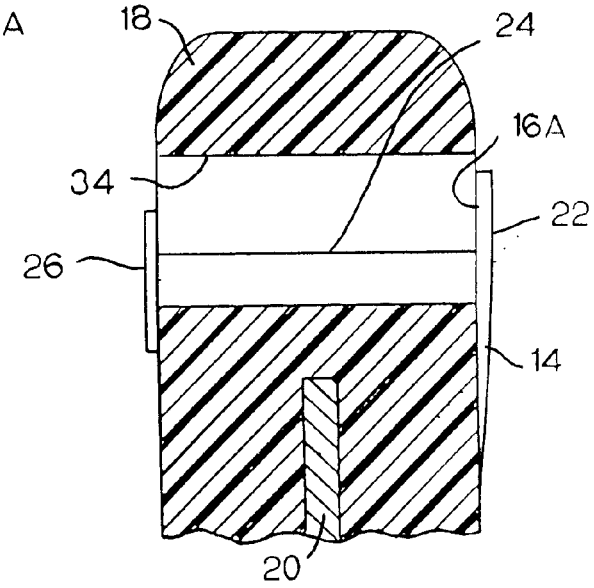
FIG. 5 is a section view along line 5-5 of FIG. 4.

The user aligns the enlarged head 26 of the pin 24 with the hole 34 (See also FIGS. 3 and 5) and slides the pin 24 into the hole 34, entering from the right side of the handle 18 (See FIG. 3), until the head 26 of the pin exits the left side of the hole 34 (See FIG. 5), with the pin 24 received in the hole 34. The inner surface of the head 26 abuts the left outer surface of the handle 18, and the inner face 16A of the strap 14 abuts the right outer surface of the handle 18, as shown in FIG. 5. Also, the distal side of the pin 24 abuts the distal edge of the hole 34.

The user then holds onto the handle 18 with one hand and pushes the end tab 32 of the hand guard 10 in the X direction (forward) with the other hand, moving the distal end 13 of the strap 14 far enough forward (in the distal direction) to align the tabs 38 on the guard 10 with the notches 36 (See FIG. 2) on the tool 12. Note that the twist in the strap 14 means that the spring force in the strap 14 acts in two directions, both in the Y direction, crosswise to the longitudinal direction of the tool, and in the X direction, along the longitudinal direction of the tool. The spring force in the Y direction urges the proximal end of the strap 14 to the left and the distal end 13 of the strap 14 to the right.

When the tabs 38 on the guard 10 are aligned with the notches 36 on the tool 12, the user slides the distal end of the strap 14 to the right, causing the tabs 38 of the strap 14 to pass through the notches 36 of the tool 12 until the long dimension portion $d_2$ formed by the arms 30B of the T-slot 30 receives the tool 12, and then the distal end of the strap 14 is slid longitudinally in the proximal direction, as shown in phantom in FIGS. 3 and 4, until the distal end of the strap 14 abuts the shoulder 42 on the tool 12, to secure the distal end of the strap 14 onto the tool 12.

At this point, the closed side of the T-slot 30 on the strap 14 abuts the left side of the tool 12 adjacent to the shoulder 42, and the inner face 16A of the strap 14 abuts the right side of the tool 12 adjacent to the hole 34. This keeps a spring tension on the strap acting in the crosswise direction, urging the proximal securement means (the pin 24 with enlarged head 26) to the left and urging the distal securement means (the T-shaped slotted opening 30) to the right, which keeps both the proximal and distal securement means in the secured position.

Since the cross-piece portion of the T-shaped slotted opening 30 is only wide enough to accommodate the thickness of the blade 20, the wide inner face 16A of the strap 14 abuts against the distal end 42 of the handle 18. At the same time, the pin 24 abuts against the distal side of the opening 34, as shown in FIG. 5.

The spring tension in the strap 14 thus is pulling the pin 24 forward, in the distal direction, causing the pin 24 to press against the distal side of the hole 34, and is pulling the distal end of the inner face 16A of the strap 14 rearwardly, in the proximal direction, pushing against the distal shoulder 42.

This spring force in the X direction prevents the enlarged head 26 of the pin 24 at the proximal end 11 of the strap 14 from moving rearwardly to become aligned with the opening 34 for removal through the opening 34 and prevents the slotted portion 30 at the distal end 13 of the strap from moving forward to a point at which the tabs 38 are aligned with the slots 36 to remove the distal end 13 of the strap 14 from the tool 12. In other words, the spring force on the guard 10 acts to maintain both the proximal and distal securement means on the guard in a secured position both in the longitudinal direction and in the crosswise direction.

It should be obvious that the guard 10 alternatively may be attached to the tool 12 by first aligning the "T"-shaped slot 30 with the notches 36 and then pulling back on the proximal end 11 to insert the enlargement 26 through the opening 34. Reversing the order of the installation results in the same installed configuration.

It also should be obvious that the configuration of the guard 10 may be reversed so that the enlarged head 26 enters the opening 34 from the left side of the handle 18 and the "T"-shaped slot 30 slides on and impacts against the right side of the tool 12, without altering the principle of installation of the guard 10.

Figure 8:
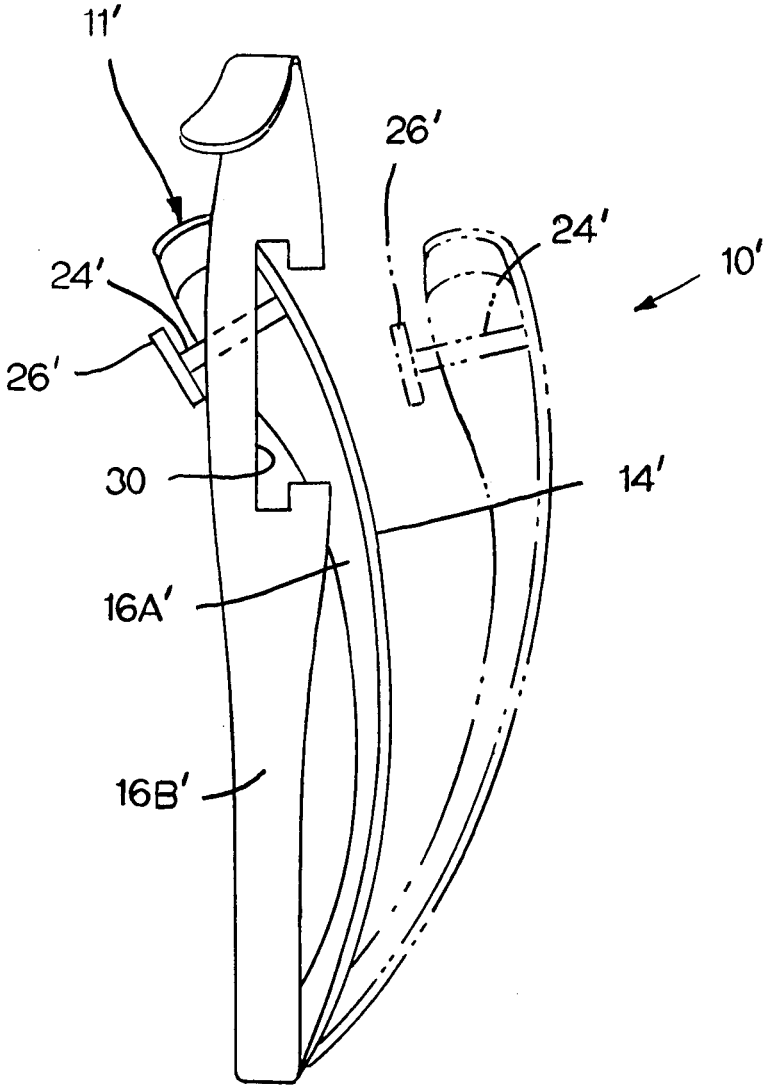
FIG. 8 is a view similar to FIG. 1 but showing the embodiment of FIG. 6.
Figure 9:
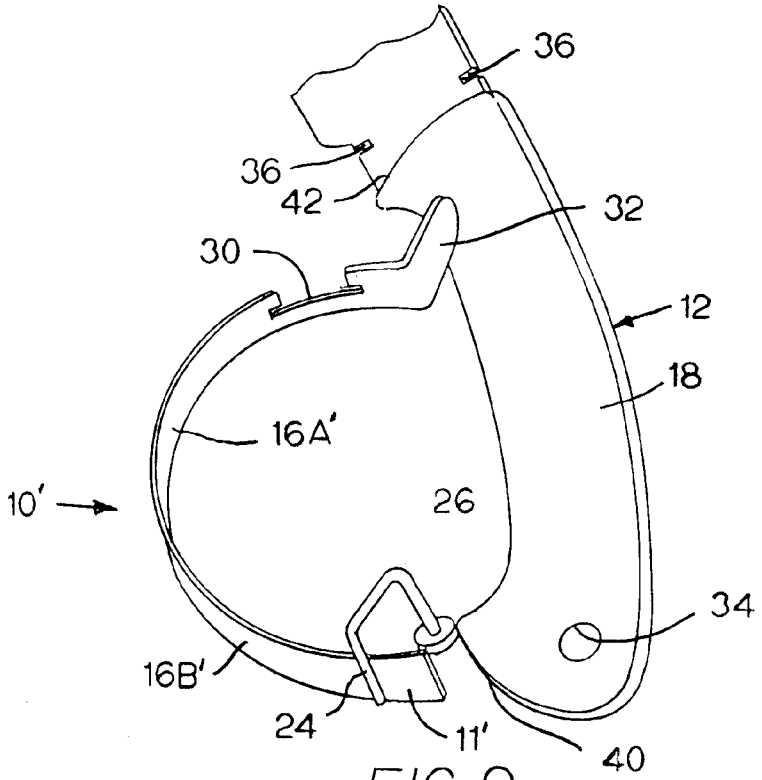
FIG. 9 is a perspective, partially broken-away view of the tool with the hand guard of FIGS. 6 and 7 adjacent to the tool in preparation for installation.
Figure 10:
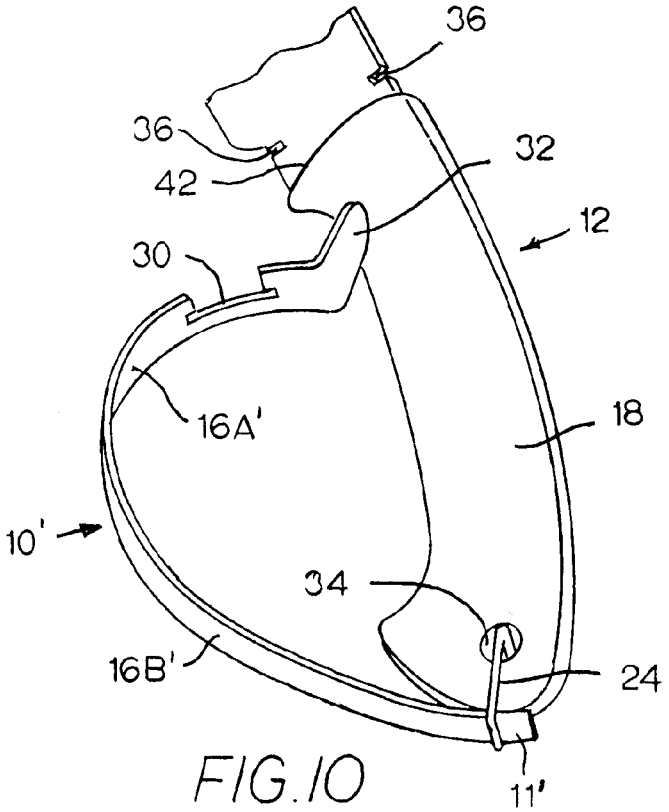
FIG. 10 is a perspective, partially broken-away view of the tool with the hand guard of FIG. 9 partially installed (at the proximal end) of the tool.

FIGS. 6 through 10 show a second embodiment of a hand guard 10' mounted on a tool 12. FIG. 8 shows the hand guard 10' of FIGS. 6 and 7 without the tool. The most substantial difference between this guard 10' and the previously described guard 10 is that the proximal end 11' of this guard 10' wraps around the rear of the handle 18 as well as around the right side of the handle 18. This guard 10' also does not have as much of a twist as in the first embodiment, but it still has crosswise tension due to the front of the guard 10' being offset laterally from the rear. In this instance, the handle 18 itself provides an opposing surface 40, in addition to the surface at the distal end of the opening 34 to prevent the proximal end of the guard 10' from collapsing and possibly pinching the fingers of the hand it is intended to protect.

The installation of this guard 10' is the same as for the guard 10, and the principle of operation is the same; namely tensile forces (stresses) acting within the guard 10' in a longitudinal direction and in a crosswise direction operate to keep the guard mounted on the tool 12.

A first force operates in the crosswise direction Y (See FIG. 1) to keep the proximal end of the guard 10' (the central portion of the pin 24) pressed against the right side of the handle 18 while keeping the closed side of the "T"-shaped slot 30 pressed against the left side of the tool 12. A second force operates in the longitudinal direction X to keep the pin 24 pressed against the distal edge of the hole 34 in the handle 18 (See also FIGS. 5 and 7) while keeping the inner face 16A' at the distal end of the strap 14' pressed against the distal shoulder 42 of the tool 12.

The enlarged head of the pin 24, when shifted in the distal direction due to the tensile forces in the longitudinal direction X, prevents the pin 24 from accidentally shifting out of the opening 34. Similarly, the slotted groove 30, when shifted in the proximal direction due to the tensile forces in the longitudinal direction, prevents the distal end of the guard 10' from accidentally disengaging from the tool.

It also should be noted that the positions of the securing mechanisms could be reversed, with the hole through the tool and the pin on the guard being at the distal end and the T-shaped slotted opening and recesses being at the proximal end, or both the distal and proximal ends could use a pin and hole, or both the distal and proximal ends could use a T-shaped slotted opening and recesses.

It will be obvious to those skilled in the art that modifications may be made to the embodiments described above without departing from the scope of the present invention as claimed.

What is claimed is:

1. A hand guard for a tool handle, comprising:

a strap having a proximal end and a distal end, an outer face and an inner face, first and second edges, and a longitudinal direction extending from said proximal end to said distal end;

a pin projecting inwardly from the proximal end of the strap, said pin having an enlarged head spaced inwardly a distance away from the strap; and said strap defining a T-shaped opening at the distal end of the strap, said T-shaped opening having a base and two arms, with an open side at the base, said open side being open through the first edge of the strap, and a closed side at the two arms, said base having a first dimension in the longitudinal direction between a first tab and a second tab, and said arms being recessed away from said first edge and having a second dimension in the longitudinal direction that is greater than the first dimension.

2. A hand guard for a tool handle as recited in claim 1, and further comprising a tool, including a tool handle having left and right sides, top and bottom edges, a proximal end and a distal end which defines a distal shoulder, said tool handle defining a hole adjacent the proximal end of the tool handle, and said tool defining opposed recesses in the top and bottom edges distal to the distal shoulder, wherein said tool defines a distance between said opposed recesses in said top and bottom edges; wherein said pin is received through said hole, with the enlarged head extending outside of the tool handle, and wherein said first dimension of said base is slightly larger than said distance between said opposed recesses, such that the distal end of the strap can be slid onto the tool at the recesses and can then be moved proximally with the tool being received in the arms of the T-shaped opening to lock the distal end of the strap onto the tool.

3. A hand guard for a tool handle as recited in claim 2, wherein said strap is made of a flexible, spring-like material that can be distorted from an "at rest" shape and that tends to return to the "at rest" shape when released, wherein when the strap is installed on the handle, with the pin through the hole and the portion of the strap adjacent to the T-shaped opening receiving the tool and abutting the distal shoulder, the spring-like material is extended in the longitudinal direction from said "at rest" shape and is twisted to create a spring force in said strap that keeps the strap in tension, exerting forces both in the longitudinal direction and in a direction crosswise to the longitudinal direction.

4. A hand guard for a tool handle as recited in claim 3, wherein the force in the longitudinal direction presses the pin against an edge of the hole and presses the distal end of the strap against the distal shoulder and the force in the crosswise direction urges the pin into the hole and pushes the closed side of the T-shaped opening against the tool.

5. A method for installing a hand guard on a tool with a handle having an elongated direction, comprising the steps of:

sliding a first securement means at a proximal end of a hand guard strap in a direction crosswise to the elongated direction of the tool handle and adjacent to the respective end of the tool handle to engage the tool and then in a direction along the elongated direction of the tool handle to secure said first securement means on said tool;

wherein said first securement means includes a pin with an enlarged head projecting from the proximal end of the hand guard strap, and said step of sliding said first securement means in a direction crosswise to the elongated direction of the tool handle includes sliding said pin through a hole in said tool handle until said enlarged head exits said hole and lies outside of said tool handle; and said step of sliding said first securement means in a direction along the elongated direction of the tool handle includes sliding said pin along the elongated direction of the tool handle until said pin abuts the side of said hole;

and sliding a second securement means at a distal end of the hand guard strap in a direction crosswise to the elongated direction of the tool handle to engage the tool and then in a direction along the elongated direction of the tool handle to secure said second securement means on said tool;

wherein said hand guard strap is made of a spring-like material and is in an extended position with the hand guard strap in tension when said first and second securement means of the hand guard strap are secured on said tool, with said hand guard strap being in tension between said distal and proximal ends such that the spring force in the hand guard strap creates a tension acting on said tool both in the elongated direction and in a direction crosswise to the elongated direction, with the forces in both of those directions acting to keep the first and second securement means secured to said tool.

6. A method for installing a hand guard on a tool with a handle having an elongated direction as recited in claim 5, wherein said second securement means includes a T-shaped opening through an edge of said hand guard strap and securing the second securement means includes sliding the T-shaped opening crosswise over a notched place on the tool and then sliding the T-shaped opening in the elongated direction until the hand guard strap abuts a shoulder on the tool.

7. A hand guard for a tool handle as recited in claim 1, wherein said strap has a tip at the distal end of the strap that is bent outwardly to form a forward tab located distally from the T-shaped opening.

8. A hand guard for a tool handle as recited in claim 7, wherein said strap is made of a flexible, spring-like material that can be distorted from an "at rest" shape and that tends to return to the "at rest" shape when released.

9. A hand guard for a tool handle as recited in claim 2, wherein the pin presses in the longitudinal direction against an edge of the hole.

* * * * *